US007549548B2

(12) United States Patent
Kraus et al.

(10) Patent No.: US 7,549,548 B2
(45) Date of Patent: Jun. 23, 2009

(54) HANDLED DRINKING CONTAINER

(75) Inventors: Stephanie Kraus, Glendale, CA (US); Randal Ouye, La Crescenta, CA (US)

(73) Assignee: Disney Enterprises, Inc., Burbank, CA (US)

( * ) Notice: Subject to any disclaimer, the term of this patent is extended or adjusted under 35 U.S.C. 154(b) by 422 days.

(21) Appl. No.: 11/091,973

(22) Filed: Mar. 28, 2005

(65) Prior Publication Data

US 2006/0213856 A1 Sep. 28, 2006

(51) Int. Cl.
*B65D 23/10* (2006.01)
*A61J 9/08* (2006.01)
*A61J 11/00* (2006.01)

(52) U.S. Cl. ..... 215/396; 215/11.1; 215/11.6; 215/395; 220/772

(58) Field of Classification Search ..... 215/11.6, 215/395–398, 11.1; 220/740, 741, 758, 768, 220/769, 772, 710.5
See application file for complete search history.

(56) References Cited

U.S. PATENT DOCUMENTS

| | | | | | |
|---|---|---|---|---|---|
| D38,233 | S | * | 9/1906 | Lyon | D7/622 |
| 1,428,758 | A | * | 9/1922 | Cowles | 215/11.6 |
| 1,601,888 | A | * | 10/1926 | Sico | 215/11.6 |
| 2,752,971 | A | * | 7/1956 | Tupper | 220/4.03 |
| 2,930,502 | A | * | 3/1960 | Klein | 215/395 |
| 2,981,561 | A | * | 4/1961 | Leslie | 292/341.13 |
| 3,718,360 | A | * | 2/1973 | Knutzen | 294/27.1 |
| 3,851,781 | A | * | 12/1974 | Marco | 215/11.3 |
| 3,990,596 | A | * | 11/1976 | Hoftman | 215/11.1 |
| 4,714,174 | A | | 12/1987 | Williams | |
| 4,795,052 | A | | 1/1989 | Hayes, Jr. | |
| 4,801,027 | A | | 1/1989 | Hunter | |
| 4,915,250 | A | | 4/1990 | Hayes, Jr. | |
| 4,941,579 | A | * | 7/1990 | Lee | 215/11.1 |
| 4,953,737 | A | | 9/1990 | Meyers | |
| D315,409 | S | * | 3/1991 | Baarber | D24/197 |
| 5,038,948 | A | * | 8/1991 | Signorini | 215/11.1 |
| 5,050,759 | A | | 9/1991 | Marble | |
| 5,145,077 | A | * | 9/1992 | Rohrig | 215/11.1 |
| D336,827 | S | * | 6/1993 | Knight | D7/622 |
| 5,294,018 | A | | 3/1994 | Boucher | |
| D359,657 | S | * | 6/1995 | Davidson et al. | D7/622 |
| D371,779 | S | | 7/1996 | Nowak et al. | |
| D376,734 | S | | 12/1996 | Petrie | |
| D379,495 | S | | 5/1997 | Sidman et al. | |
| D383,911 | S | | 9/1997 | Conforti et al. | |
| 5,669,665 | A | | 9/1997 | Nowak | |
| D386,104 | S | | 11/1997 | Nowak | |
| D386,703 | S | | 11/1997 | Nowak | |
| D387,239 | S | | 12/1997 | Johnstone | |

(Continued)

*Primary Examiner*—Sue A Weaver
(74) *Attorney, Agent, or Firm*—Greenberg Traurig, LLP

(57) ABSTRACT

A container, such as a baby bottle or sipper cup, includes an elongated side wall and one or more handles to either side of the elongated side wall for facilitating handling of the bottle. There is a rim at the top of the side wall for receiving a nipple locating closure. With two handles, these are diametrically opposite each other with the elongated bottle between them. The handles are formed as an integrated substantially embracive or curved element, and the element has an aperture at one section for engagement with the mounting of the bottle, and the curved element essentially surrounds the bottle. The curved element is removable from the mounting.

5 Claims, 5 Drawing Sheets

U.S. PATENT DOCUMENTS 5,692,630 A * 12/1997 Hsu ..... 215/396
D389,359 S 1/1998 Nowak
D390,135 S 2/1998 Rossman et al.
D391,407 S 3/1998 Rossman et al.
5,725,117 A 3/1998 Berjis
D394,166 S 5/1998 Rossman et al.
5,755,489 A 5/1998 Rossman et al.
5,761,756 A 6/1998 Nowak et al.
5,763,796 A 6/1998 Britto et al.
5,765,715 A 6/1998 Hughes
5,772,088 A 6/1998 Nelson
D395,832 S 7/1998 Rossman et al.
D396,292 S 7/1998 Nowak
D396,717 S 8/1998 Sidman et al.
5,799,811 A * 9/1998 Bruckner et al. ..... 215/386
5,833,189 A 11/1998 Rossman et al.
D403,842 S 1/1999 Bair et al.
5,871,118 A 2/1999 Franzese
5,890,620 A 4/1999 Belcastro
5,893,472 A 4/1999 Forrer
D411,349 S 6/1999 Johnstone
D412,292 S 7/1999 Nowak et al.
5,938,053 A 8/1999 Verbovszky et al.
D413,792 S 9/1999 Hotaling et al.
D417,275 S 11/1999 Conforti
5,993,285 A 11/1999 Sofia et al.
5,993,478 A 11/1999 Nowak
D417,914 S 12/1999 Nowak
6,000,750 A 12/1999 Rossman et al.
D419,785 S 2/2000 Conforti et al.
D421,125 S 2/2000 Nowak
D421,126 S 2/2000 Nowak
6,026,528 A 2/2000 Pina
D421,469 S 3/2000 Reinke et al.
6,033,019 A 3/2000 Hession-Kunz et al.
6,037,872 A 3/2000 Dunnum
D422,849 S 4/2000 Knight et al.
6,045,254 A 4/2000 Inbar et al.
6,049,954 A 4/2000 Britto
D424,203 S 5/2000 Nowak
D424,312 S 5/2000 Hotaling et al.
D424,958 S 5/2000 Nowak
D426,300 S 6/2000 Conforti
6,089,653 A 7/2000 Hotaling et al.
D430,052 S 8/2000 Nowak
D430,737 S 9/2000 Nowak et al.
D432,342 S 10/2000 Popek et al.
RE37,016 E 1/2001 Morano
D436,655 S 1/2001 Hotaling et al.
D436,800 S 1/2001 Nowak et al.
6,168,034 B1 1/2001 Perrone
6,176,042 B1 1/2001 Rossman et al.
6,202,247 B1 3/2001 Lorenz, Jr.
6,212,706 B1 4/2001 Rossman et al.
D443,233 S 6/2001 Gaudet et al.
6,253,392 B1 7/2001 Conforti et al.
6,269,968 B1 8/2001 Belcastro
6,322,149 B1 11/2001 Conforti et al.
6,325,236 B1 12/2001 Wong
6,354,708 B1 3/2002 Monahan et al.
D460,322 S 7/2002 Orr et al.
6,412,527 B1 7/2002 Brice
6,415,460 B1 7/2002 Rossman et al.
D461,361 S 8/2002 Orr et al.
D465,423 S 11/2002 Larson et al.
6,478,435 B2 11/2002 Monahan et al.
D467,125 S 12/2002 Orr et al.
6,499,254 B2 12/2002 Rossman et al.
D469,860 S 2/2003 Riemer et al.
6,513,379 B2 2/2003 Meyers et al.
6,536,163 B1 3/2003 Monahan et al.
6,536,502 B2 3/2003 Britto et al.
6,571,981 B2 6/2003 Rohlfs
6,578,209 B2 6/2003 Lopes et al.
D478,669 S 8/2003 Wear
6,616,000 B1 * 9/2003 Renz ..... 215/11.1
6,640,992 B1 11/2003 Berger et al.
6,648,396 B2 11/2003 Monahan et al.
6,658,678 B2 12/2003 Hotaling et al.
6,658,681 B2 12/2003 Britto et al.
6,673,036 B1 1/2004 Britto
6,692,072 B2 2/2004 Nelson et al.
6,695,678 B1 2/2004 Foley et al.
6,749,582 B2 6/2004 Britto et al.
6,802,757 B1 10/2004 Sejnowski
6,834,400 B2 12/2004 Zanardelli et al.
6,840,918 B1 1/2005 Britto et al.
D502,551 S 3/2005 Hotaling et al.
6,910,594 B2 6/2005 Foley et al.
6,923,337 B2 8/2005 Hession et al.
6,928,674 B2 8/2005 Blackburn
6,954,955 B2 10/2005 Brewin et al.
6,964,572 B2 11/2005 Cesa
6,976,604 B2 12/2005 Connors, Jr. et al.
2001/0027956 A1 * 10/2001 Bonacorso et al. ..... 215/11.1
2005/0056611 A1 * 3/2005 Hakim ..... 215/11.6
2006/0151420 A1 * 7/2006 Espenschied ..... 215/276

* cited by examiner

HANDLED DRINKING CONTAINER

BACKGROUND

1. Field

This disclosure relates to drinking container constructions. More particularly the disclosure relates to an ergonomically designed baby bottle and/or a sipper cup.

2. General Background

There are numerous baby bottles on the market, with different functions and features. None of the known bottles provide the features of the present disclosure. The prior art is replete with varying baby bottle sizes and constructions. However, none of the bottles appear to address needs that arise to collectively facilitate balance, handling, and ease of feeding infants.

While the prior art constructions may be adequate for the basic purpose and function for which they have been designed, they fail to provide a simple, efficient, and practical feeding bottle. In particular, the prior art fails to disclose a bottle sized and constructed to enhance an infant's grasp of the bottle, comfort while gripping the bottle, and increased control during the feeding process.

There is a need for an improved ergonomically designed baby bottle construction that simplifies feeding, and the support functions associated with this.

Different sipper cups are known, but these also suffer deficiencies in their utility.

It is an object of the present disclosure to provide a baby bottle and/or sipper cup to facilitate drinking, and at the same time making feeding an easier function for the feeding person.

SUMMARY

The present disclosure recognizes and addresses disadvantages of prior art constructions and an object of the present disclosure is to provide an improved drinking device in the form of a baby bottle and/or sipper cup.

A baby drinking utensil includes a container, such as a bottle or cup, which includes an elongated side wall and a mounting of the container for receiving one or more handles on the outside of the elongated side wall for facilitating handling of the container. The handles are located at radially spaced locations circumferentially around the outside of the wall. With two handles, these are diametrically opposite each other with the elongated bottle between them. The handles are formed as an integrated substantially curved element, and the element has an aperture at one section for engagement with the mounting of the container, and the curved element essentially surrounds the container. The curved element is removable from the mounting.

In another form, the handles are formed by at least a partially embracive element. Whether curved or embracive with a different configuration, the handle is removable from the mounting of the container.

The holding or embracive device is adaptable so as to be usable as a drinking cup, commonly known as a sipper cup.

There is a rim at the top of the side wall for receiving a mouthpiece for a user, namely a nipple locating closure, or in different situations, a mouthpiece for a cup.

DRAWINGS

The above-mentioned features and objects of the present disclosure will become more apparent with reference to the following description taken in conjunction with the accompanying drawings, wherein like reference numerals denote like elements, and in which.

DETAILED DESCRIPTION

Figure 1:
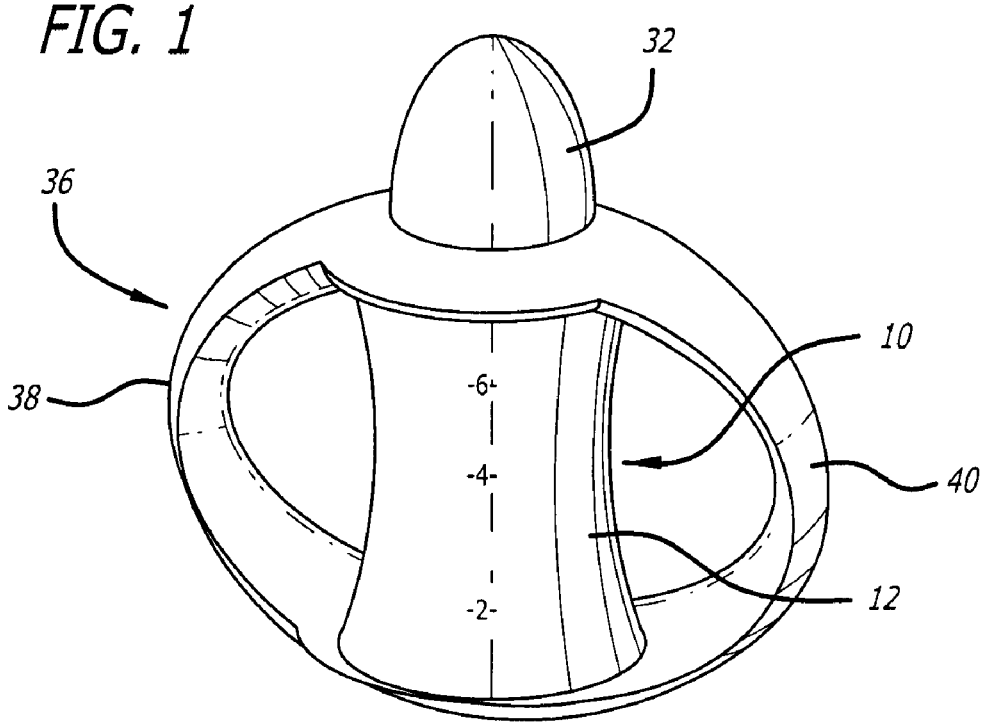
FIG. 1 is a perspective view of the first embodiment.

The device is now described with reference to an example which is not to be considered as limiting. This is purely an illustration of the device.

One of ordinary skill in the art will understand that the present discussion is a description of exemplary embodiments only, and is not intended as limiting the broader aspects of the present disclosure, which broader aspects are embodied in the exemplary construction. A repeat use of reference characters in the present specification and drawings represents the same or analogous features or elements of the disclosure.

A container in the form of a baby bottle or sipper cup includes an elongated side wall and a mounting of the container for receiving more than one handle to either side of the elongated side wall for facilitating handling of the container.

There are preferably at least two handles, and the two handles are diametrically opposite each other with the elongated bottle between them. The handles are formed as an integrated substantially curved element, and the element has an aperture at one section for engagement with the mounting of the bottle or cup. The curved portion essentially surrounds the bottle or cup.

The curved element is removable from the mounting, and the mounting is located towards the top of the bottle or cup. The curved element is to either side of the bottle or cup and there is a relatively flat portion locatable towards the base of the bottle or cup. The bottle or cup fits with the handles. The base of the bottle or cup is adjacent the flat portion joining the curved elements, and the neck of the bottle constitutes at least part of the mounting and passes through the aperture in the curved element.

In some other forms, the baby bottle or cup has an elongated side wall, and a mounting for receiving a handle for facilitating handling of the bottle or cup. There can be a single handle which extends substantially from the top of the bottle or cup to a base. The handle is formed so as to be mounted at a position towards the top of the bottle or cup, namely between the bottle top and the nipple closure structure, and extend towards the base of the bottle. The handle is removable from the bottle by releasing the nipple closure structure from the bottle.

There is a rim at the top of the side wall for receiving a nipple locating closure.

The baby bottle or cup includes a lid for the bottle or cup with a neck which passes through the aperture in the handle structure such that the end of the neck extends beyond an area defined by the handle or handles.

The embracive element includes a portion locatable towards the base of the bottle or cup. The bottle or cup fits with the handles and with the base of the bottle or cup adjacent the flat portion.

The embracive element includes a side profile that is relatively narrower at a portion between the top and the bottom of the embracive element. The embracive element includes a front profile that is relatively substantially elliptical with a major axis for the element being transverse to the longitudinal axis of a bottle or cup, and with relatively flat portions at the ends of the minor axis.

The nipple locating closure is for location on the side of the mounting opposite the location of the elongated portion of the bottle. In other cases, a mouthpiece is provided in place of the nipple locating closure. The mouthpiece has an element for receiving the lips of a baby to facilitate sucking or sipping.

The lid has an aperture with an extending peripheral edge. The lid is for location with a rim at the top of the bottle, with the edge extending through a mating hole in a mounting structure forming part of the securing for the handles with the bottle. The nipple locating closure is located on the peripheral edge of the lid on the side of the mounting opposite the location of the bottle relative to the handles.

There is a cover for the nipple locating closure or mouthpiece. The cover is removable, and the cover is curved and blends with the closure. The cover is located on the side of the mounting opposite the location of the bottle relative to the handles.

The baby bottle or cup can include a concaved or convexed elongated side wall.

Figure 3:
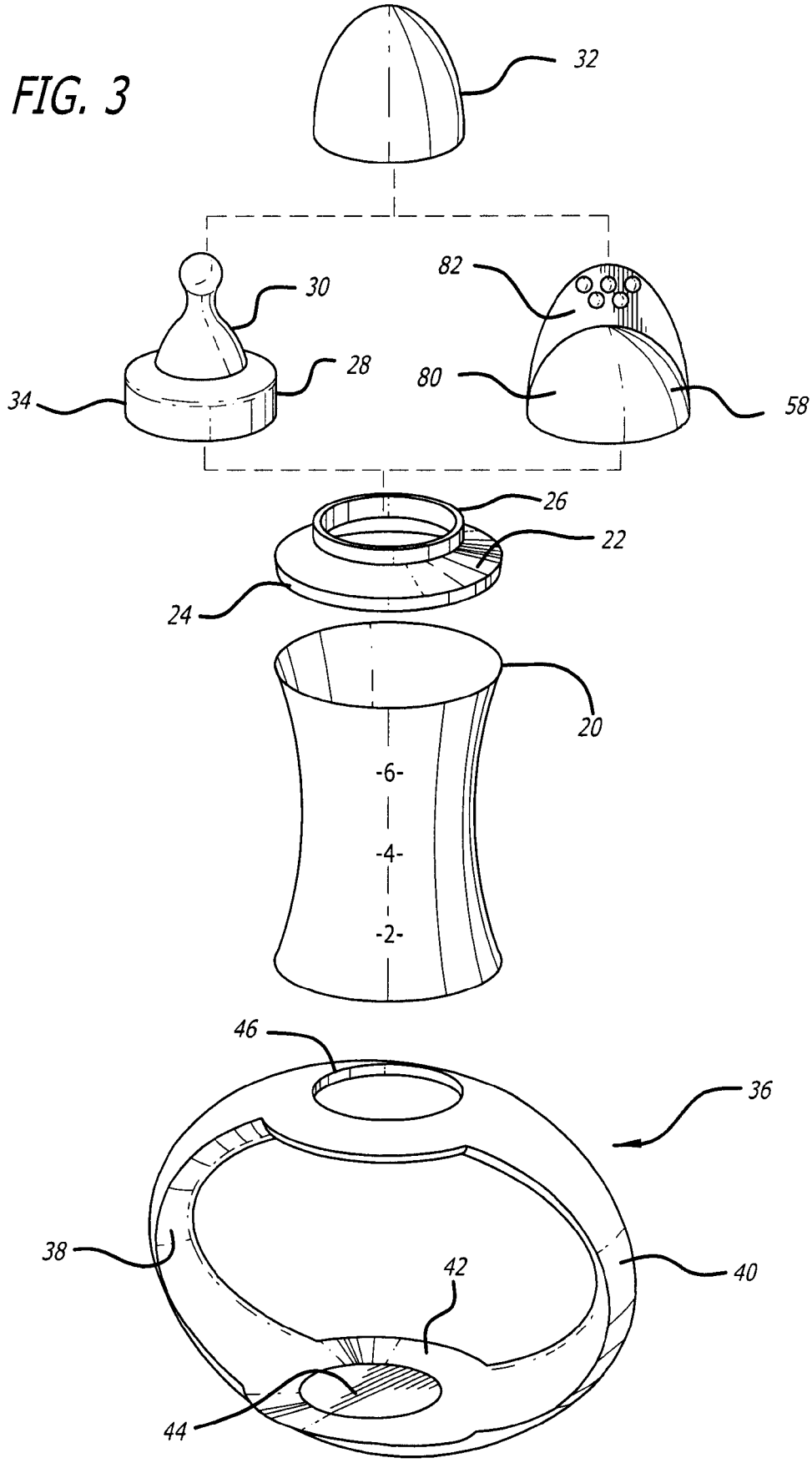
FIG. 3 is an exploded perspective view of the components of the first embodiment.

FIG. 1 shows an elongated baby bottle 10, which has a relatively concave side wall 12, in that the central portion of the side wall is less in diameter than the ends 14 and 16. The end 14 includes a flat base 18. The top of bottle 10 includes a rim 20 (see FIG. 3), which engages with a lid 22, which itself has a circumferential rim 24 for engaging with the rim 20 at the top of the bottle. The lid 22 includes a central area with an upstanding lip 26. At the top of the lip 26 there will be located a nipple holding portion 28, and the nipple 30 is located in an aperture within the nipple holding portion 28. A cover 32 is also provided and this cover 32 is for engagement about a periphery area 34 on the nipple securing portion 28. The lid 22 and lip 26, along with aperture 46, FIG. 3, provide a mounting for the bottle 10.

The bottle 10 is secured in an embracing device 36, which effectively has two handles 38 and 40, which are located at either side of the bottle 10 when in place with the embracing handle device. The embracing handle device can have different shapes, and it can be circular, or, as shown in the exemplary drawings, elliptical with a major axis extending transversely relative to the longitudinal axis through the bottle 10. The minor axis is essentially longitudinal with the longitudinal axis of the bottle when located in place.

The securing device includes a base section 42 with a flat foundation 44, which seats the flat portion 18 at the bottom of the bottle 10. There is an aperture 46 in the top portion of the circular handle and the lip 26 passes through that aperture when the bottle 10 is in place. In this fashion, the bottle 10 is located firmly in place with the two handles 38 and 40 at either side of the bottle 10. The nipple retaining component 28 can be placed on the bottle on the side remote from the embracing section, and the cover can be put in place as may be needed.

Figure 2:
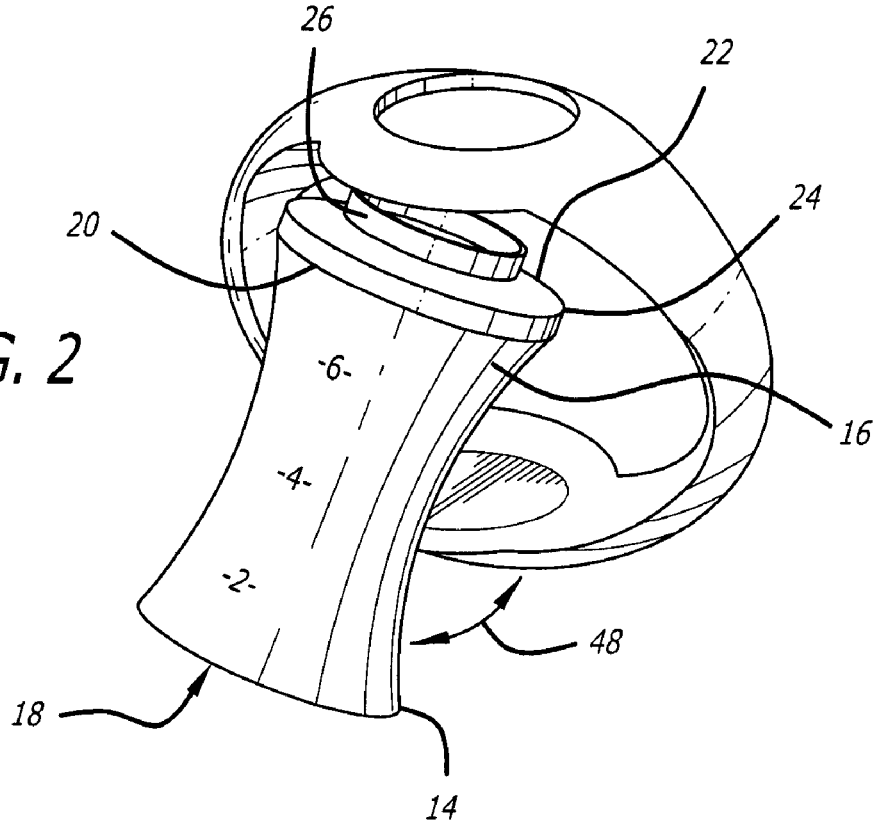
FIG. 2 is a partially disassembled view showing the first embodiment bottle being removed from the handle.

As shown in FIG. 2, the arrow 48 indicates how the bottle 10 can be moved in and out of location within the embracing ring.

After the baby has become older, the handles may not be necessary and in this case, the bottle 10 can be used in a conventional manner without the two handles 38 and 40 formed by the ring 36.

Also as shown in FIG. 3 there is a mouthpiece 58 for use with the container when it is in the form of a cup, such as a sipper cup.

Figure 8:
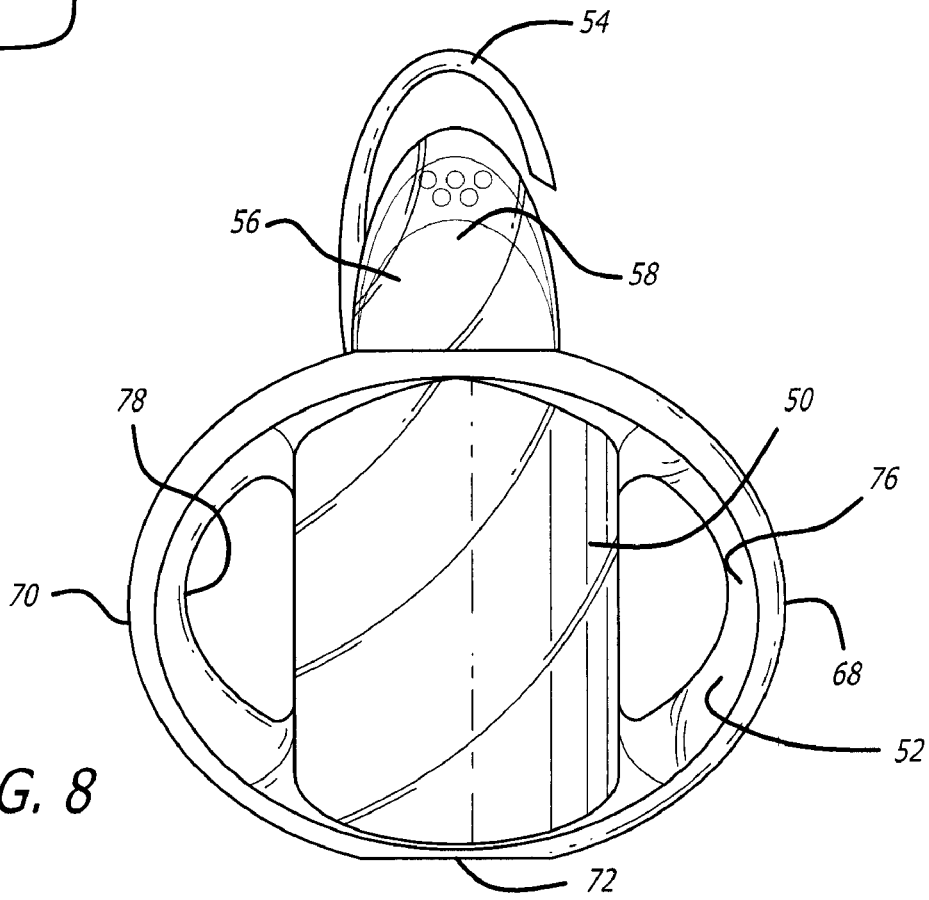
FIG. 8 is a front elevation view of the second embodiment with an alternate interface piece.

In the form of the disclosure shown in FIG. 8, the bottle 50 forms part of an internal ring 52.

Figure 6:
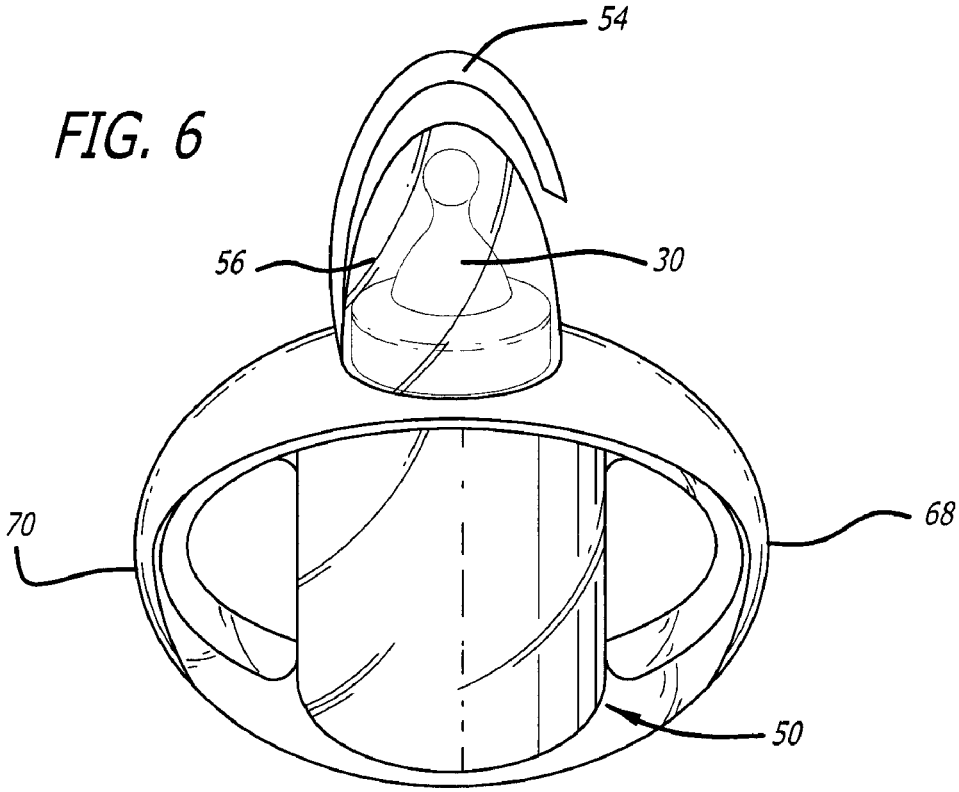
FIG. 6 is a perspective view of the second embodiment.

As shown in FIG. 6, there is also a removable hook device 54, which extends from a cover 56, which goes over the nipple 30.

There is a rim 60, which is formed on the outside of the circle embracing handles, and the nipple 62 fits on that rim, and a securing section 64 for securing the nipple fits over the nipple and is secured to the rim 60 as necessary. The bottle 50 of this embodiment is shown with a convex configuration, at least on that side.

The handles 68 and 70 are such that their mid-portion is of a lesser width than the base 72 or the top 74.

Figure 4:
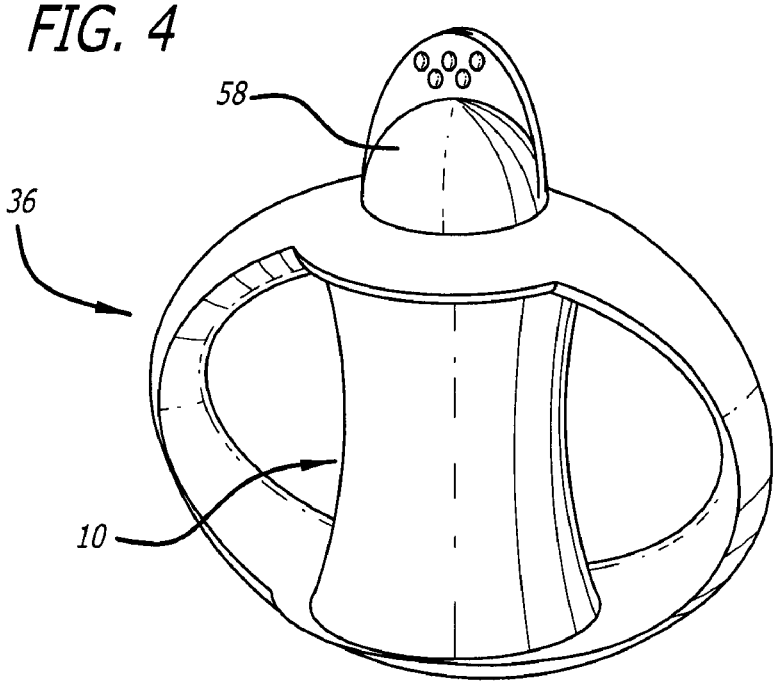
FIG. 4 is a perspective view of the first embodiment with an alternate interface piece.
Figure 5:
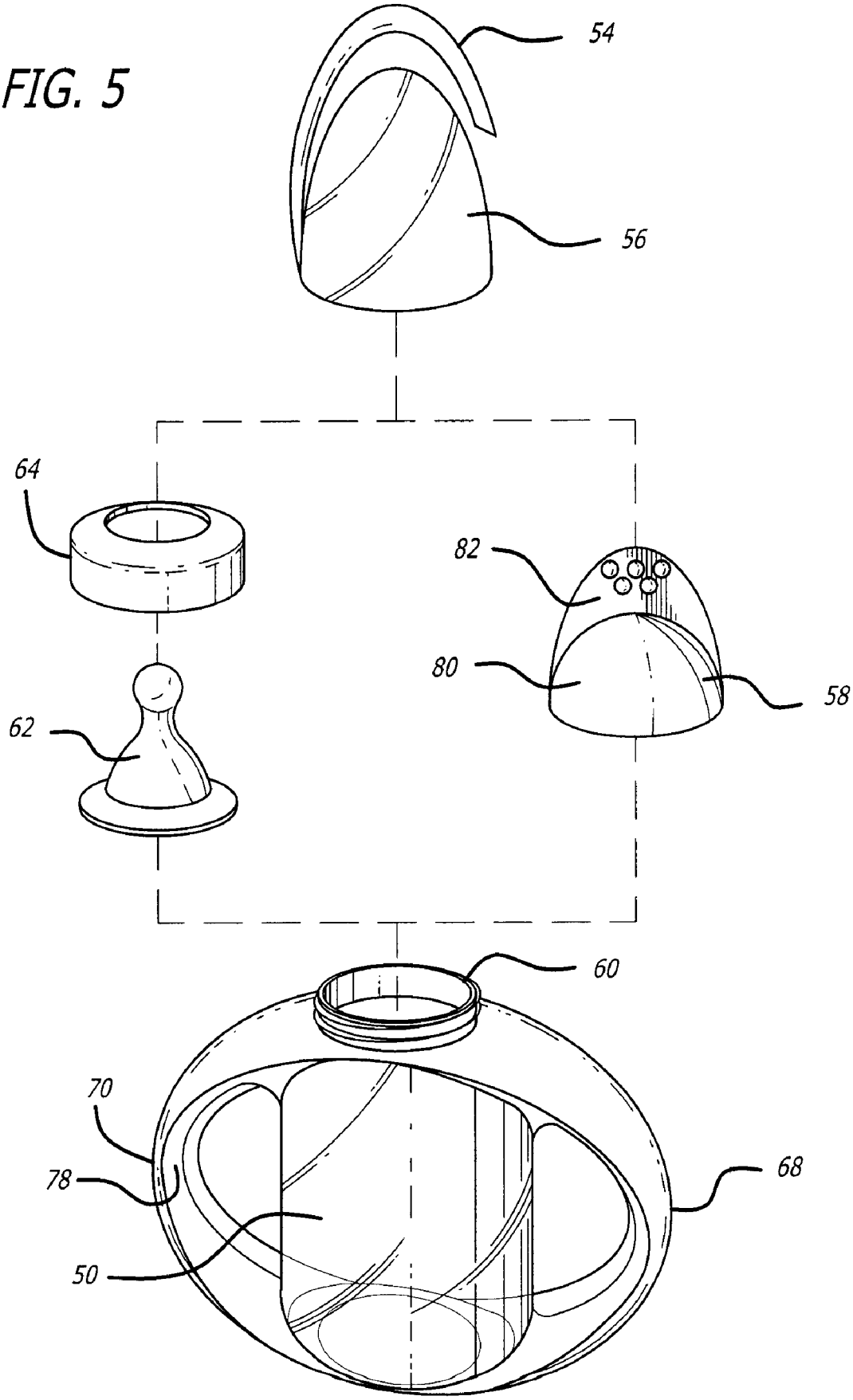
FIG. 5 is an exploded perspective view of the components of the second embodiment.
Figure 7:
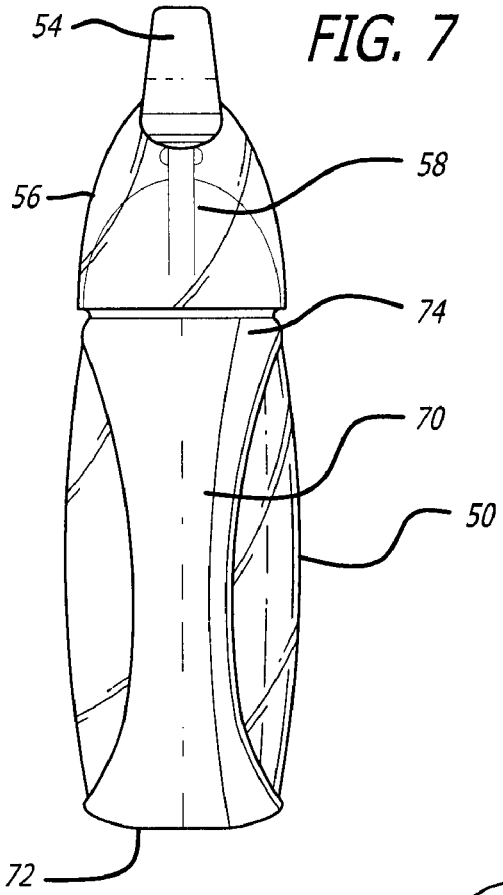
FIG. 7 is a side elevation view of the second embodiment with an alternate interface piece.

The example of FIGS. 4, 5, and 6 are such that the two-handled training bottle fits the hands of the baby. The cushioned grip facilitates handling. Standard nipples and nipple rings can be used. In other cases, there can be a no-spill, self-sip toddler spout used instead of the nipple. As such, the outlet for the bottle can be either a nipple, a mouthpiece, or a spout, as desired.

In this configuration, the bottle 50 and internal configuration rings 76 and 78, mate with the external rings 68 and 70, a configuration less intended to be separated from the handle configuration. In different configurations, the construct can be of a nature that it is not separable from that configuration.

The mouthpiece 58 is configured to have a hemispherical section 80 and a suction grip section 82 formed about the hemispherical section 80. The suction section 82 is formed for securing the lips of a baby.

The cylindrical top portion and the body may be molded of a suitable plastic material, which may be blow molded, by extrusion or injection, so that it is a unitary member of uniform wall thickness. A suitable transparent plastic for forming the bottle includes, but is not limited to, polystyrene, polystyrene-acrylonitile, acrylonitile-butadiene-styrene, styrene-maleicanhydride, polycarbonate, polyethylene terephthalate, polyvinylcyclohexane, and blends thereof.

The baby bottle can be formed from any desired conventional material such as glass or plastic. The bottle preferably has a generally circular, but not essentially, cross-sectional area. Thus, for instance, it can be rectangular or other desired shape which can be curved to a greater or lesser extent. The bottle side wall can be straight, curved in part, or whole, and have grip formations for fingers if desired. More than two handles can be provided. Instead of being at 180° radial spacing, the spacing may be less than 180°, for instance 90° or 120°.

While the device and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. A fluid container comprising a base, an elongated side wall extending upwardly from said base, a mounting of the container for facilitating handling of the container, and a rim at the top of the side wall for receiving a mouthpiece locating closure for securing a mouthpiece for a user, said mounting including a lid for the container, the lid having a centrally located aperture with an upstanding lip surrounding the aperture, the lid being engageable with said rim at the top of the container with the lip extending through a mating hole in a mounting structure having an outer surface and an inner surface forming part of the mounting of the container, and wherein the mouthpiece locating closure is engageable with said lip of the lid within the mating hole of the mounting structure, said lid abutting against the inner surface of said mounting structure with the lip of said lid extending through said mating hole with said mouthpiece locating closure abutting against the outer surface of said mounting structure, said mounting structure having a flat portion for receiving the base of the container, said mounting structure including a pair of spaced handles, one of said handles extending from said mating hole to said flat portion on one side of said mounting structure and the other of said handles extending from said mating hole to said flat portion opposite said one of said handles, wherein the container is retained between the handles of the mounting structure and the base of the container is adjacent to the flat portion.

2. The container of claim 1, wherein the mounting structure has a top and bottom and includes a side profile that is relatively narrower at a portion between the top and the bottom of the mounting structure.

3. The container of claim 1, including a cover for the mouthpiece locating closure, the cover being removable, and wherein the cover has an exterior surface and is curved on the exterior thereof.

4. A fluid container having a closed base, an elongated side wall, an opening at top, said sidewall interconnecting the top and the closed base, a mounting of the container for receiving at least two handles forming an integrated unit for facilitating handling of the container, the handles being located at radially spaced positions circumferentially around the outside of the side wall of the container, said mounting including a lid closing off the top of said container having a centrally located upstanding lip, said container terminating at said top in a rim, said rim receiving thereon said lid adapted to receive a locating closure for a mouthpiece for a user, and wherein the two handles are diametrically opposite each other with the container therebetween, said mounting including a mounting structure, said handles forming an opening in said mounting structure at one end receiving said lip therein, said handles extending from said rim to the base of said container, said mounting structure having an inner surface and an outer surface with said opening therethrough at one end thereof, said lid abutting against the inner surface of said mounting structure with the lip of said lid extending through said opening in said mounting structure with said locating closure abutting against the outer surface of said mounting structure, said mounting structure having a flat portion for receiving the base of the container, wherein the container is retained between such handles and the base of the container is adjacent to the flat portion.

5. The container of claim 4, wherein the elongated side wall of said container is concave.

* * * * *